US006509723B2

(12) United States Patent
Matsushita

(10) Patent No.: US 6,509,723 B2
(45) Date of Patent: Jan. 21, 2003

(54) CONSTANT VOLTAGE REGULATOR, METHOD OF CONTROLLING THE SAME, AND ELECTRIC DEVICE PROVIDED WITH THE SAME

(75) Inventor: Akimasa Matsushita, Saitama (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/028,112

(22) Filed: Dec. 20, 2001

(65) Prior Publication Data

US 2002/0079873 A1 Jun. 27, 2002

(51) Int. Cl.[7] ..... G05F 1/40
(52) U.S. Cl. ..... 323/281
(58) Field of Search ..... 323/280, 281, 323/284

(56) References Cited

U.S. PATENT DOCUMENTS 4,008,418 A * 2/1977 Murphy ..... 323/226
4,950,975 A * 8/1990 Fleischer ..... 323/266
5,578,960 A * 11/1996 Matsumura et al. ..... 323/276
6,201,674 B1 * 3/2001 Warita et al. ..... 323/277
6,366,068 B1 * 4/2002 Morishita ..... 323/282

FOREIGN PATENT DOCUMENTS

JP B2-4-61590 10/1992 ..... H02M/3/28

* cited by examiner

*Primary Examiner*—Bao Q. Vu
(74) *Attorney, Agent, or Firm*—Scully, Scott, Murphy & Presser

(57) ABSTRACT

To supply a constant voltage to a load at the time of activating the load. In a constant voltage regulator provided with an overcurrent preventing unit that prevents an overcurrent from flowing in a load at a time of an overload level, there is provided a controlling unit that turns off the overcurrent preventing unit when the load is activated.

8 Claims, 6 Drawing Sheets

1 : CONSTANT CURRENT SOURCE
2 : DIFFERENTIAL AMPLIFIER
3 : DRIVER TRANSISTOR (SWITCHING UNIT)
4 : OUTPUT VOLTAGE SETTING RESISTOR
5 : OUTPUT VOLTAGE SETTING RESISTOR
6 : REFERENCE VOLTAGE SOURCE
7 : OUTPUT CURRENT LIMITING CIRCUIT
8 : OUTPUT CURRENT LIMITING CIRCUIT FUNCTION SELECTING TERMINAL

1 : CONSTANT CURRENT SOURCE
2 : DIFFERENTIAL AMPLIFIER
3 : DRIVER TRANSISTOR (SWITCHING UNIT)
4 : OUTPUT VOLTAGE SETTING RESISTOR
5 : OUTPUT VOLTAGE SETTING RESISTOR
6 : REFERENCE VOLTAGE SOURCE
7 : OUTPUT CURRENT LIMITING CIRCUIT
8 : OUTPUT CURRENT LIMITING CIRCUIT FUNCTION SELECTING TERMINAL

1 : CONSTANT CURRENT SOURCE
2 : DIFFERENTIAL AMPLIFIER
3 : DRIVER TRANSISTOR
4 : OUTPUT VOLTAGE SETTING RESISTOR
5 : OUTPUT VOLTAGE SETTING RESISTOR
6 : REFERENCE VOLTAGE SOURCE
7 : OUTPUT CURRENT LIMITING CIRCUIT
8 : OUTPUT CURRENT LIMITING CIRCUIT FUNCTION SELECTING TERMINAL
9 : CURRENT LIMITING RESISTOR
10 : DELAY CAPACITOR

1 : CONSTANT CURRENT SOURCE
2 : DIFFERENTIAL AMPLIFIER
3 : DRIVER TRANSISTOR (SWITCHING UNIT)
4 : OUTPUT VOLTAGE SETTING RESISTOR
5 : OUTPUT VOLTAGE SETTING RESISTOR
6 : REFERENCE VOLTAGE SOURCE
7 : OUTPUT CURRENT LIMITING CIRCUIT

CONSTANT VOLTAGE REGULATOR, METHOD OF CONTROLLING THE SAME, AND ELECTRIC DEVICE PROVIDED WITH THE SAME

BACKGROUND OF THE INVENTION

1. Field of the Invention

The present invention relates to a constant voltage regulator that applies a constant voltage to a load, a method of controlling the regulator, and an electric device provided with the regulator.

2. Description of the Prior Art

Each of the conventional constant voltage regulators is provided with a driver transistor for applying a constant voltage to a load. And, an amount of a control current for turning on this driver transistor is limited when the constant voltage regulator is overloaded, for example, when an output terminal of the regulator is short-circuited, thereby the constant voltage can be applied to the load even after the load increases excessively.

FIG. 7 shows an explanatory circuit diagram of a conventional constant voltage regulator. In FIG. 7, reference numeral 1 denotes a constant current source, reference numeral 2 denotes a differential amplifier, reference numeral 3 denotes a driver transistor, reference numerals 4 and 5 denote output voltage setting resistors, reference numeral 6 denotes a reference voltage source, and reference numeral 7 denotes an output current limiting circuit.

At first, a voltage is applied to a Vin terminal as an input terminal while a load is connected to a Vout terminal as an output terminal. Then, a power is supplied to the differential amplifier 2. A power is also supplied to the reference voltage source 6 via the Vin terminal and the constant current source 1, respectively. A change of the output voltage between a GND terminal and the Vout terminal is detected by a voltage dividing circuit composed of the output voltage setting resistors 4 and 5, then fed back towards the differential amplifier 2. The voltage fed back to the differential amplifier 2 is inputted to a positive pole terminal of the differential amplifier 2.

A voltage signal from the reference voltage source 6 is also inputted to a negative pole terminal of the differential amplifier 2. Then the level of each inputted signal is compared. The differential amplifier 2 then amplifies a differential voltage, which is the result of comparison. According to this amplified signal, the driver transistor 3 is controlled so as to eliminate change of the voltage output from the Vout terminal. Here, the output current limiting circuit 7 provided for each of conventional constant voltage regulators limits an amount of the current flowing in the driver transistor 3 so as to block the flow of any excessive current to the Vout terminal, for example, even when the Vout terminal is short-circuited with the GND terminal.

Any of the conventional regulator techniques, however, cannot supply a constant voltage to a load, since the regulator is provided with an output current limiting circuit, thereby the output voltage might drop due to a capacity of the load when the load is activated. This is a problem to be solved.

BRIEF SUMMARY OF THE INVENTION

Object of the Invention

Under such circumstances, it is an object of the present invention to provide a constant voltage regulator that can supply a constant voltage to a load when the load is activated.

SUMMARY OF THE INVENTION

In order to solve the above problem, the constant voltage regulator of the present invention, which is provided with an overcurrent preventing unit for preventing an overcurrent flowing in a load at a time of overload level, is further provided with controlling unit for turning off the overcurrent preventing unit when the load is activated.

Furthermore, it is another object of the present invention to provide a method for controlling the constant voltage regulator provided with overcurrent preventing unit for preventing an overcurrent flowing in the load at a time of overload level, and a controlling unit for turning on/off the overcurrent preventing unit. The controlling unit turns off the overcurrent preventing unit when the load is activated by the controlling unit.

It is still another object of the present invention to provide an electric device provided with the constant voltage regulator as described above.

BRIEF DESCRIPTION OF THE DRAWINGS

This above-mentioned and other objects, features and advantages of this invention will become more apparent by reference to the following detailed description of the invention taken in conjunction with the accompanying drawings, wherein.

DETAILED DESCRIPTION OF THE PREFERRED EMBODIMENTS

Hereunder, preferred embodiments of the present invention will be described with reference to the accompanying drawings.

(First Embodiment)

[Description of Configuration]

Figure 1:
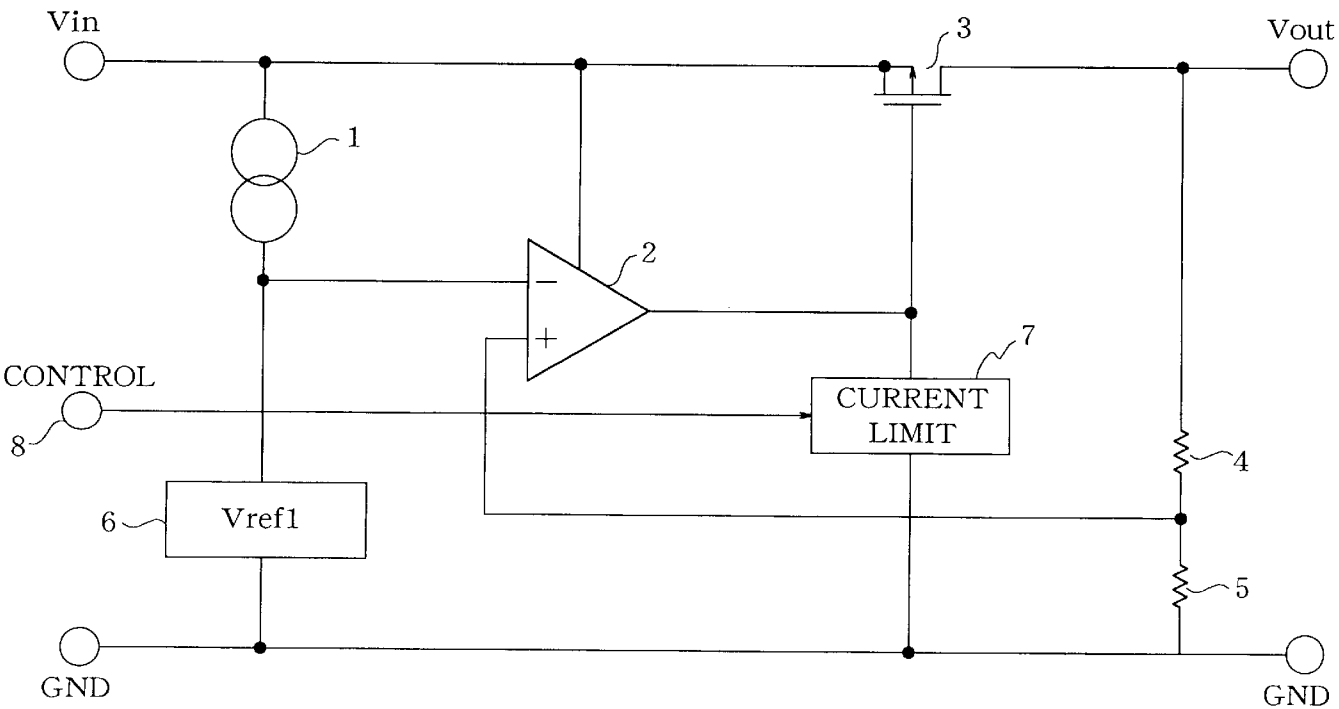
FIG. 1 is an explanatory circuit diagram of a constant voltage regulator in the first embodiment of the present invention.

FIG. 1 shows an explanatory circuit diagram of a constant voltage regulator in the first embodiment of the present invention. In FIG. 1, reference numeral 1 denotes a constant current source, reference numeral 2 denotes a differential amplifier, reference numeral 3 denotes a driver transistor (switching unit), reference numerals 4 and 5 denote output voltage setting resistors (output voltage change detecting unit), reference numeral 6 denotes a reference voltage source, reference numeral 7 denotes an output current limiting circuit as an overcurrent preventing unit, and reference numeral 8 denotes an output current limiting circuit function selecting terminal as a controlling unit.

[Description of Operation]

Figure 2:
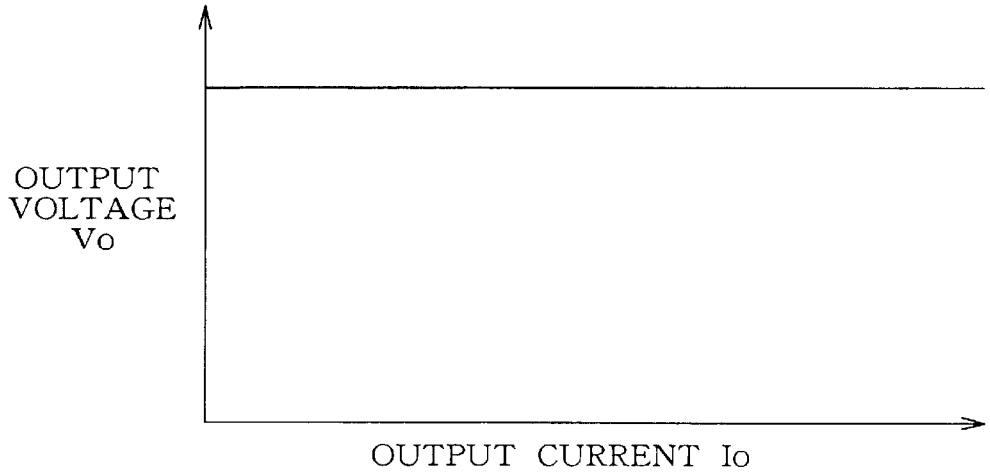
FIG. 2 is an illustration for showing a relationship between an output current and an output voltage of a Vout terminal when an output current limiting circuit is turned off by an output current limiting circuit function selecting terminal shown in FIG. 1.
Figure 3:
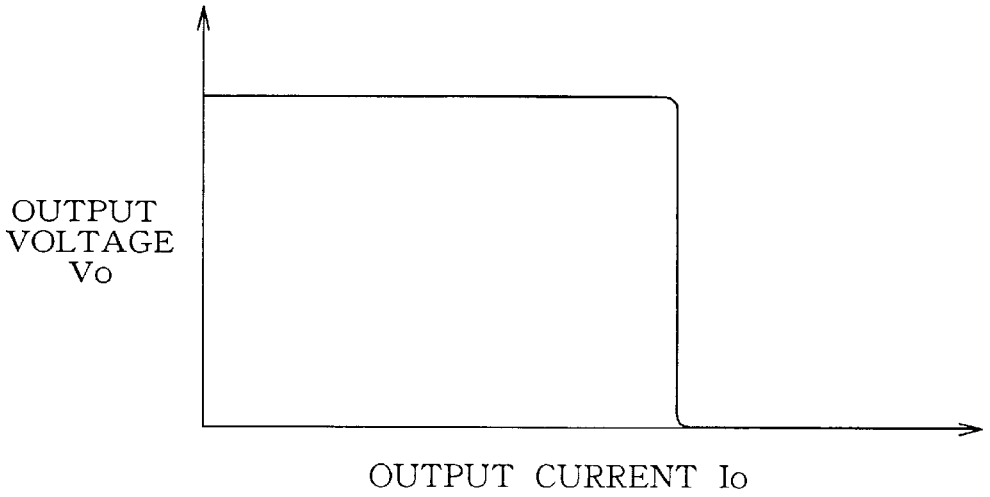
FIG. 3 is an illustration for showing a relationship between an output current and an output voltage of the Vout terminal when the output current limiting circuit is turned on by the output current limiting circuit function selecting terminal shown in FIG. 1.
Figure 4:
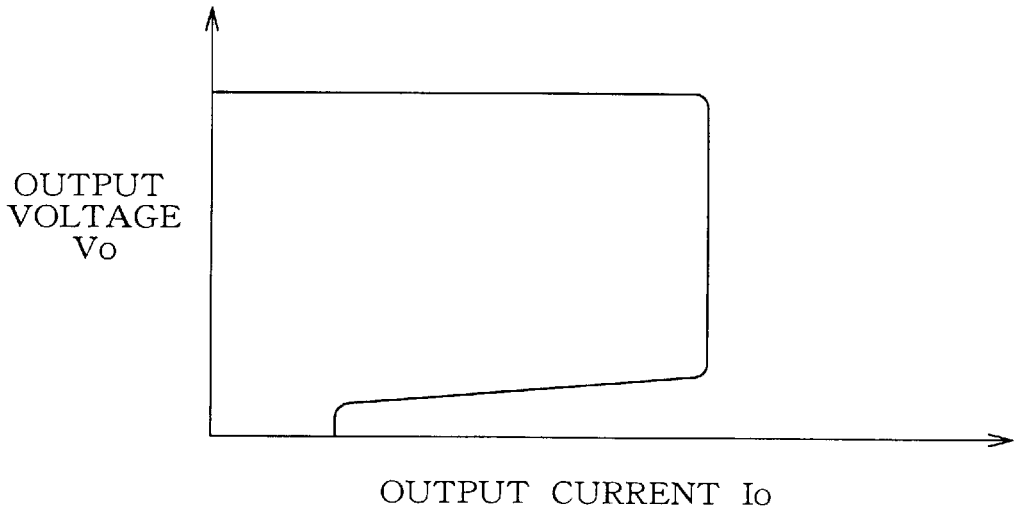
FIG. 4 is an illustration for showing a relationship between an output current and an output voltage of the Vout terminal when a hold-back type output current limiting circuit is turned on by the output current limiting circuit function selecting terminal shown in FIG. 1.

FIG. 2 illustrates a relationship between an output current and an output voltage of a Vout terminal when the output current limiting circuit 7 is turned off by the output current limiting circuit function selecting terminal 8. FIG. 3 illustrates a relationship between an output current and an output voltage of the vout terminal when the output current limiting circuit 7 is turned on by the output current limiting circuit function selecting terminal 8. FIG. 4 illustrates a relationship between an output current and an output voltage of the Vout terminal when a hold-back type output current limiting circuit 7 is turned on by the output current limiting circuit function selecting terminal 8.

Next, a description will be made for the operation of the constant voltage regulator shown in FIG. 1 with reference to FIGS. 2 through 4. At first, a voltage is supplied to the Vin terminal while a load is connected to the Vout terminal. Then, a electric power is supplied to the differential amplifier 2. A power is also supplied to the reference voltage source 6 via the Vin terminal and the constant current source 1, respectively.

And, a change of the output voltage between the GND terminal and the Vout terminal is detected by a voltage dividing circuit composed of the output voltage setting resistors 4 and 5, then fed back towards the differential amplifier 2. The fed-back output voltage is then inputted to the positive pole terminal of the differential amplifier 2. And, a voltage signal is inputted to the negative terminal of the differential amplifier 2 from the reference voltage source 6. Then the level of each signal inputted to the differential amplifier 2 is compared.

The differential amplifier 2 amplifies a differential voltage as the result of the comparison. And, according to this amplified signal, the driver transistor 3 is controlled so as to eliminate changes of the output voltage of the Vout terminal. Here, when a load is activated, an L(Low) level signal is inputted to the output current limiting circuit function selecting terminal 8, thereby the output current limiting circuit 7 is turned off and a constant voltage is output to the Vout terminal as shown in FIG. 2.

On the other hand, after the load is activated, an H(High) level signal is inputted to the output current limiting circuit function selecting terminal 8, thereby the output current limiting circuit 7 is turned on. As a result, the level of the output voltage to the Vout terminal drops when the output current exceeds a predetermined level as shown in FIGS. 3 or 4, thereby it prevents an excessive current flown in the load.

As described above, according to this embodiment, the output current limiting circuit 7 is turned off when the load is activated, thereby preventing the Vout voltage from dropping. Then, the output current limiting circuit 7 is turned on, thereby preventing an overcurrent from flowing in the load even when the constant voltage regulator is overloaded cause of short-circuit between the Vout terminal and the GND terminal.

(Second Embodiment)

[Description of Configuration]

Figure 5:
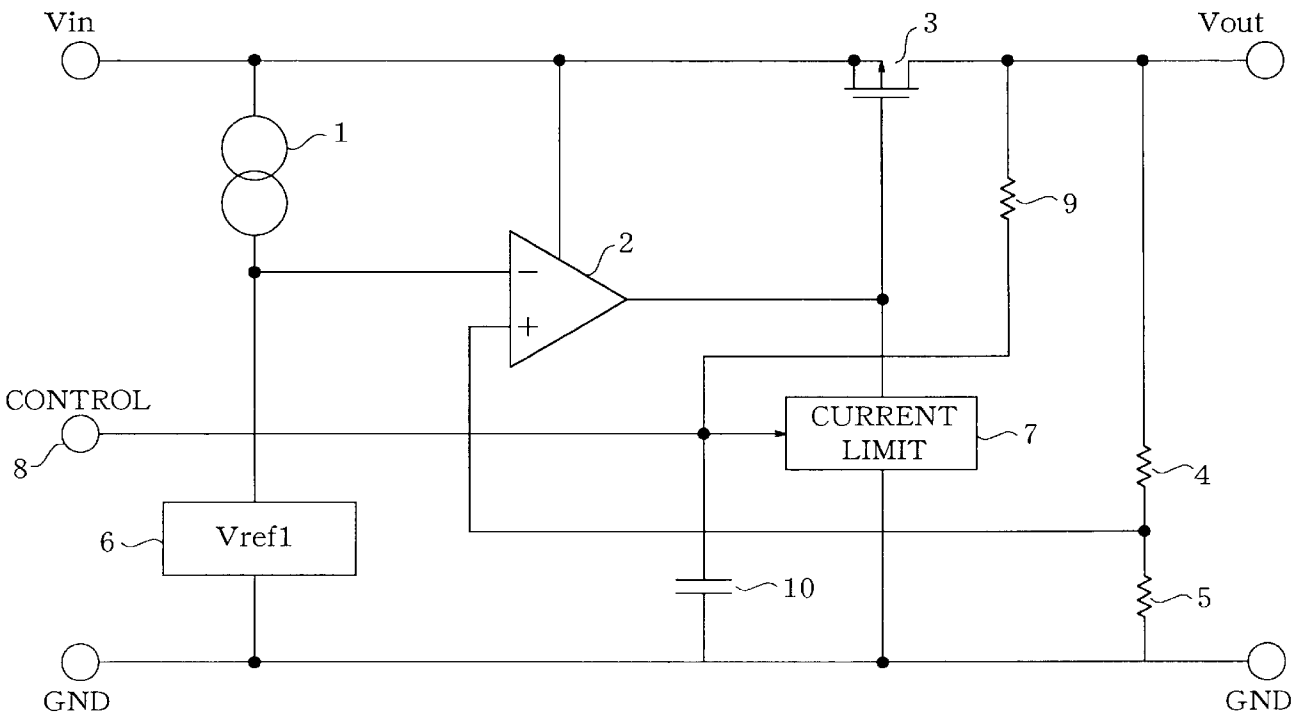
FIG. 5 is an explanatory circuit diagram of a constant voltage regulator in the second embodiment of the present invention.

FIG. 5 shows an explanatory circuit diagram of a constant voltage regulator in a second embodiment of the present invention. In FIG. 5, reference numerals 9 and 10 denote a current limiting resistor and a delay capacitor 10 used to compose an activation detecting unit, respectively. In FIG. 5, the same reference numerals are given to the same items is as those shown in FIG. 1.

[Description of Operation]

Figure 6A:
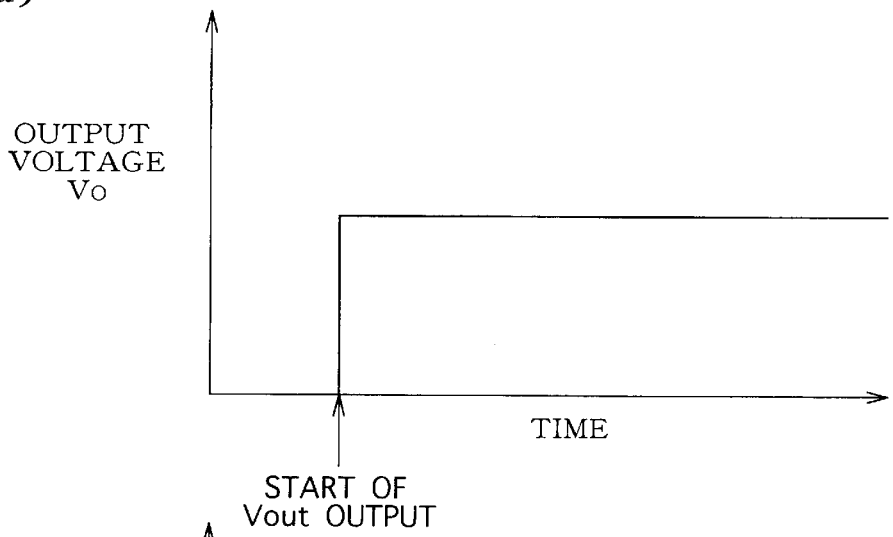
FIG. 6 is an illustration for denoting an output voltage Vo of the Vout terminal and an input signal of the output current limiting circuit, as well as how the output current limiting circuit is turned on/off.
Figure 6B:
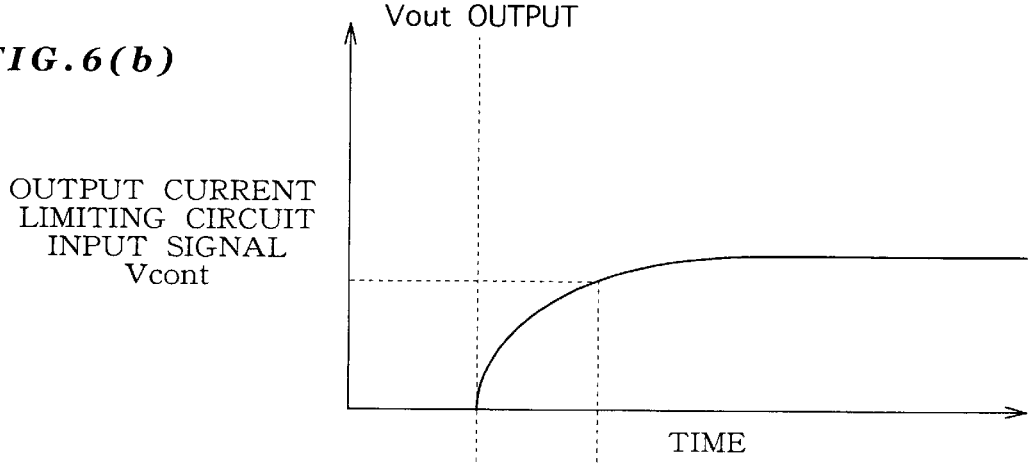
Figure 6C:
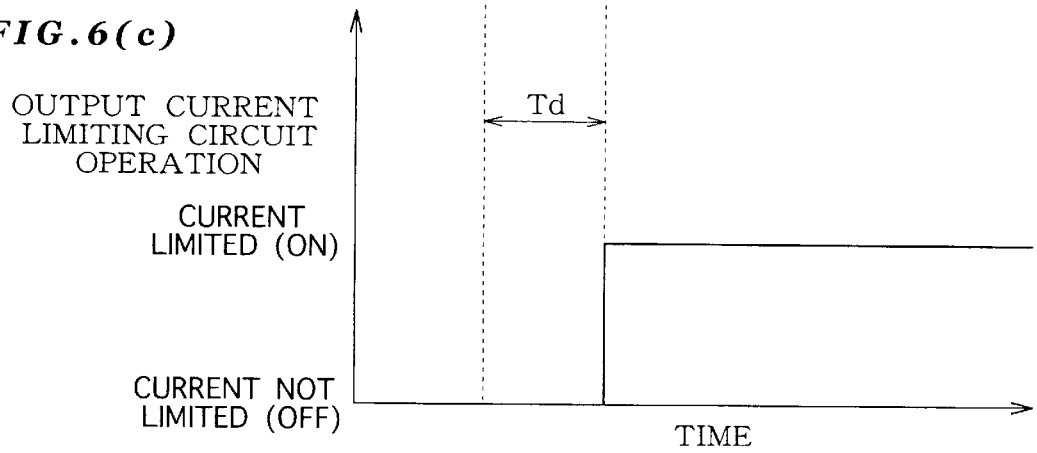
Figure 7:
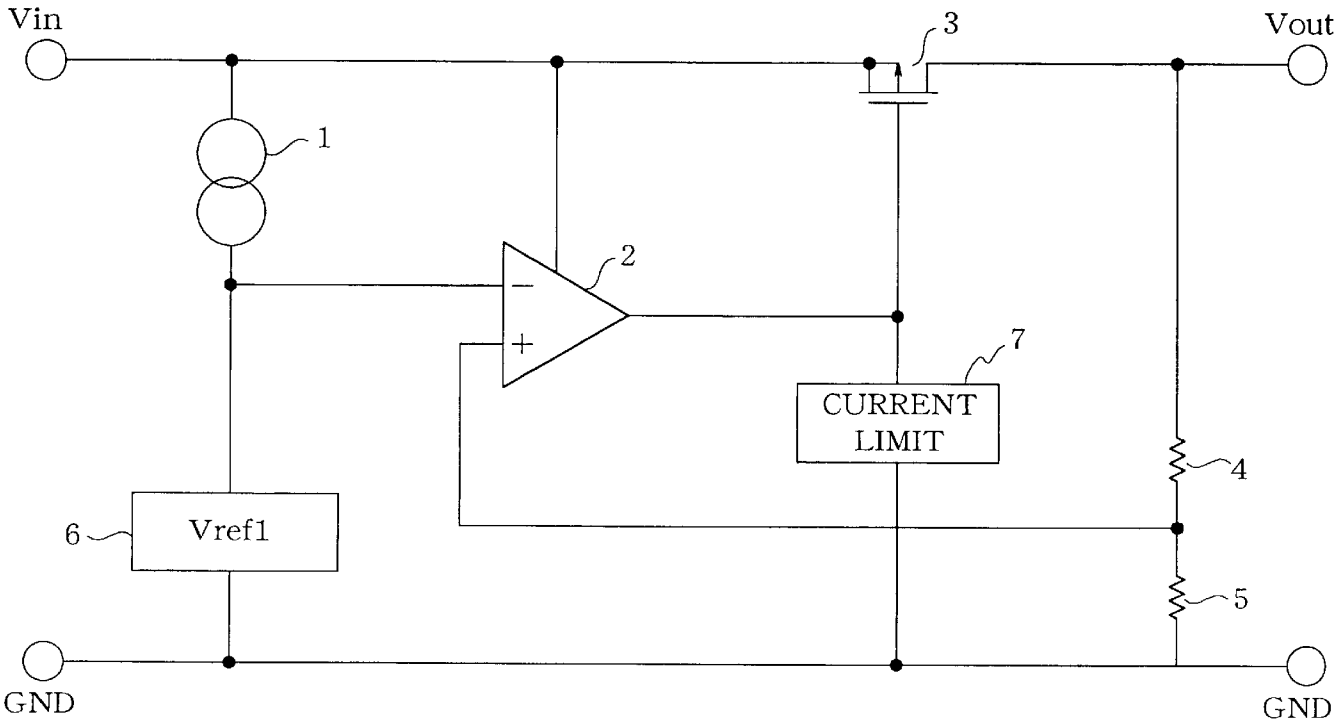
FIG. 7 is an explanatory circuit diagram of a conventional constant voltage regulator.

FIG. 6(*a*) shows the voltage Vo output from the Vout terminal and FIG. 6(*b*) shows a signal inputted to the output current limiting circuit 7. FIG. 6(*c*) shows how the output current limiting circuit 7 is turned on/off. Hereunder, the operation of the circuit 7 shown in FIG. 5 will be described with reference to FIG. 6.

In the case where a voltage is applied to the Vin terminal while the output current limiting circuit 7 is turned off and a load is connected to the Vout terminal, a constant voltage is applied to the load from the constant voltage regulator. That is, as shown in FIG. 6(*a*), the output from the Vout terminal is started.

Then, a current is flown into the delay capacitor 10 via the current limiting resistor 9 in response to the output voltage Vo. The delay capacitor 10 accumulates the current. Consequently, a signal inputted to the output current limiting circuit 7 is risen by a time constant corresponding to the resistor value of the current limiting resistor 9 and the capacity of the delay capacitor 10 as shown in FIG. 6(*b*).

As a result, the on-timing of the output current limiting circuit 7 can be delayed only by the time Td shown in FIG. 6(*c*) with respect to the rising time of the voltage output from the Vout terminal. The output current limiting circuit 7 is thus turned off during the Td time after the rising of the Vout. On the other hand, the output current limiting circuit 7 is turned on after the time Td is up. Here, since the time Td can be changed in response to a change of the time constant, it is possible to select a proper value of the current limiting resistor 9 and a proper capacity of the delay capacitor 10 as needed.

As described above, the constant voltage regulator in the above embodiments of the present invention can be utilized for various kinds of electric devices so as to apply a stable constant voltage to each of those electric devices, thereby stabilizing the operation.

As described above, according to the present invention, the constant voltage regulator provided with overcurrent preventing unit that prevents an overcurrent from flowing in a load that has reached an excessive level is enabled to turn off the preventing unit when the load is activated, thereby a constant voltage can be supplied to the load without causing a voltage drop.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and rage of equivalency of the claims are therefore intended to be embraced therein.

The entire disclosure of Japanese Patent Application No. 2000-392905 (Filed on Dec. 25, 2000) including specification, claims, drawings and summary are incorporated herein by reference in its entirety.

What is claimed is:

1. A constant voltage regulator provided with an overcurrent preventing unit for preventing an overcurrent flowing in a load at a time of an overload level, comprising a controlling unit, provided separately from an output terminal to said load, for turning off said overcurrent preventing unit when said load is activated.

2. The constant voltage regulator according to claim 1, further comprising an activation detecting unit for detecting activation of said load, wherein said controlling unit turns on said overcurrent preventing unit according to a detection result of said activation detecting unit.

3. The constant voltage regulator according to claim 1, further comprising:

an output voltage change detecting unit for detecting a level change of an output voltage;

a differential amplifying unit for amplifying a difference between said voltage detected by said output voltage change detecting unit and a reference voltage; and a switching unit that is turned on/off according to an output signal from said differential amplifying unit.

4. A method for controlling a constant voltage regulator including an overcurrent preventing unit for preventing an overcurrent flowing in a load at a time of an overload level and a controlling unit, provided separately from an output terminal to said load, for turning on/off said overcurrent preventing unit, the method comprising the step of:

turning off said overcurrent preventing unit by said controlling unit when said load is activated.

5. A method for controlling a constant voltage regulator according to claim 4, wherein said controlling unit turns on said overcurrent preventing unit after said load is activated.

6. An electric device comprising:

a constant voltage regulator provided with an overcurrent preventing unit that prevents an overcurrent flowing in a load at a time of overload level, and a controlling unit, provided separately from an output terminal to said load, for turning off said overcurrent preventing unit when said load is activated.

7. The electric device according to claim 6, wherein said constant voltage regulator further includes an activation detecting unit for detecting activation of said load, and said controlling unit turns on said overcurrent preventing unit according to a detection result of said activation detecting unit.

8. The electric device according to claim 6, wherein said electric device further includes:

output voltage change detecting unit that detects a level change of an output voltage;

differential amplifying unit for amplifying a difference between said changed voltage detected by said output voltage change detecting unit and a reference voltage; and a switching unit that is turned on/off according to an output signal from said differential amplifying unit.

* * * * *